US009818392B2

(12) United States Patent
Hwang et al.

(10) Patent No.: US 9,818,392 B2
(45) Date of Patent: Nov. 14, 2017

(54) SUCTION UNIT

(71) Applicant: LG ELECTRONICS INC., Seoul (KR)

(72) Inventors: Geunbae Hwang, Seoul (KR); Jaehyun Kim, Seoul (KR); Goondong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/240,676

(22) Filed: Aug. 18, 2016

(65) Prior Publication Data

US 2017/0053634 A1 Feb. 23, 2017

(30) Foreign Application Priority Data

Aug. 18, 2015 (KR) ..... 10-2015-0115957

(51) Int. Cl.

| | |
|---|---|
| ***A47L 9/00*** | (2006.01) |
| ***F04D 29/66*** | (2006.01) |
| ***G10K 11/16*** | (2006.01) |
| ***A47L 9/22*** | (2006.01) |
| ***G10K 11/172*** | (2006.01) |

(52) U.S. Cl.

CPC ..... *G10K 11/161* (2013.01); *A47L 9/0081* (2013.01); *A47L 9/22* (2013.01); *G10K 11/172* (2013.01)

(58) Field of Classification Search

CPC ..... A47L 9/0081; F04D 29/665
USPC ..... 181/202, 231
See application file for complete search history.

(56) References Cited

U.S. PATENT DOCUMENTS 5,159,738 A * 11/1992 Sunagawa ..... A47L 9/0081 15/326
6,094,774 A * 8/2000 Larsen ..... A47L 5/22 15/326
6,192,551 B1 * 2/2001 Roth ..... A47L 7/0019 15/326

(Continued)

FOREIGN PATENT DOCUMENTS

| | | |
|---|---|---|
| KR | 10-1436631 B1 | 8/2014 |
| WO | 2013124939 | 8/2013 |
| WO | 2014021116 | 2/2014 |

OTHER PUBLICATIONS

Extended European Search Report in European Application No. 16184826.2, dated Mar. 10, 2017, 6 pages (with English translation).

*Primary Examiner* — Jeremy Luks
(74) *Attorney, Agent, or Firm* — Fish & Richardson P.C.

(57) ABSTRACT

A suction unit includes a suction motor for generating air flow; a noise reduction unit which surrounds the suction motor and acts as a resonator in order to reduce noise generated during the operation of the suction motor; and a motor chamber which surrounds the noise reduction unit. The noise reduction unit includes an air flow path which provide a path of air flowing by the suction motor, a noise reduction chamber for eliminating the noise of at least one frequency band, and at least one communicating hole which causes sound wave of the noise to enter the noise reduction chamber. The air flow path is divided from the noise reduction chamber and thus the sound wave of the noise enters the noise reduction chamber through the communicating hole during a process in which air passes through the air flow path.

19 Claims, 6 Drawing Sheets

(56) References Cited

U.S. PATENT DOCUMENTS

| | | | | |
|---|---|---|---|---|
| 2006/0277711 | A1* | 12/2006 | Hong | A47L 9/0081 15/326 |
| 2007/0143952 | A1* | 6/2007 | Hong | A47L 5/362 15/327.7 |
| 2007/0151072 | A1* | 7/2007 | Lee | A47L 9/0081 15/353 |
| 2008/0209669 | A1 | 9/2008 | Kah | |
| 2012/0311814 | A1 | 12/2012 | Kah, Jr. | |
| 2015/0129353 | A1* | 5/2015 | Petersen | A47L 9/0081 181/212 |

* cited by examiner

SUCTION UNIT

CROSS-REFERENCE TO RELATED APPLICATIONS

This application claims priority under 35 U.S.C. §119 and 35 U.S.C. §365 to Korean Application No. 10-2015-0115957 (filed on Aug. 18, 2015), which is hereby incorporated by reference in its entirety.

BACKGROUND

1. Field

The present disclosure relates to a suction unit.

2. Background

Generally, the suction unit may be provided in a cleaner and be used to suck the air including the dust.

The suction unit may include a suction motor and a motor chamber housing the suction motor. Noise is generated in a process of operating the suction motor. Accordingly, a resonator may be used in order to reduce the noise.

A noise reduction device of a vacuum cleaner is disclosed in Korea Patent Publication No. 10-0710232 (registration date Apr. 16, 2007) which is a related art of the present disclosure.

The noise reduction device of related art includes a resonator provided in the outside of the motor chamber. The resonator is provided in the outside of the outer peripheral surface of the motor chamber.

However, according to the related art, the resonator is capable of reducing the noise with a specific frequency, however there is a problem that since the resonator is provided in the outside of the motor chamber, a portion of the air flowing by the suction motor may flow the resonator and then vortex is generated in the inlet side of the resonator and thus the flow noise due to the vortex is increased.

SUMMARY

The present disclosure is directed to a suction unit which is capable of minimizing noise generated when a suction motor is operated.

The present disclosure is directed to a suction unit which is capable of reducing discharge noise without increasing or changing the size thereof, by a reduction unit being mounted on the upstream portion and the downstream portion of the suction motor.

A suction unit includes a suction motor for generating air flow; a noise reduction unit which surrounds the suction motor and acts as a resonator in order to reduce noise generated during the operation of the suction motor; and a motor chamber which surrounds the noise reduction unit. The noise reduction unit includes an air flow path which provide a path of air flowing by the suction motor, a noise reduction chamber for eliminating the noise of at least one frequency band, and at least one communicating hole which causes sound wave of the noise to enter the noise reduction chamber. The air flow path is divided from the noise reduction chamber and thus the sound wave of the noise enters the noise reduction chamber through the communicating hole during a process in which air passes through the air flow path.

According to the present invention, since the noise reduction unit provided within the motor chamber houses the suction motor, the noise reduction unit is primarily capable of reducing the noise and the motor chamber is secondarily capable of reducing the noise. Accordingly, three is an advantage that the noise generated during the operation of the suction motor is further capable of being reduced.

In addition, since a plurality of communicating holes are formed in the circumferential direction of the guide body in the process of air flowing the guide body, a generation of the flowing noise of air due to swirl in the perimeter of the communicating hole may be prevented.

Further, since the noise reduction unit directly surrounds the suction motor, distance in which the sound wave of the noise of the specific frequency band moves to the noise reduction unit is reduced. According to this, there is an advantage that the change of the frequency of the sound wave is minimized in the process of the sound wave of the noise being moved and thus the reduction of capability of the sound reduction unit is prevented.

In addition, in a case of the present invention, there is an advantage that the noise reduction unit is disposed in the upstream or the downstream of the suction motor in the motor chamber, and thus the discharging noise may be reduced without increasing or changing the size of the noise reduction unit.

DETAILED DESCRIPTION OF THE EMBODIMENTS

Figure 1:
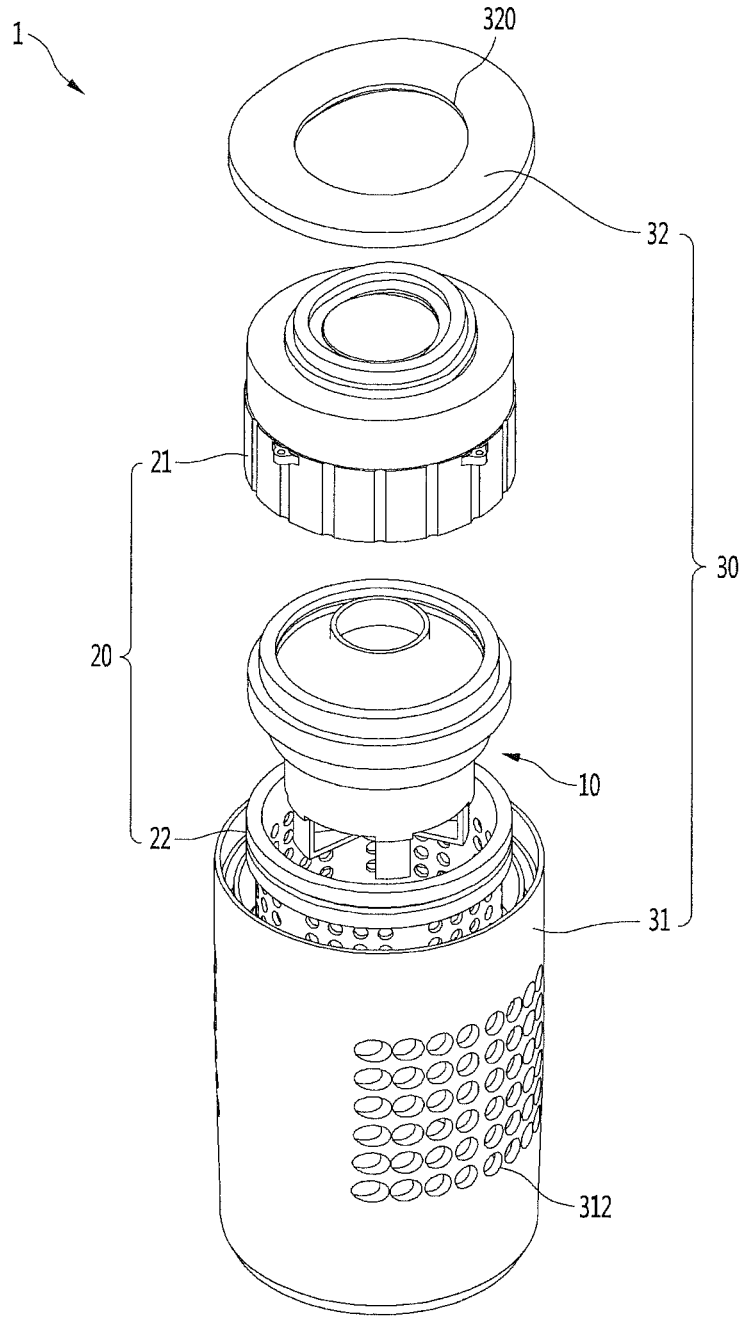
FIG. 1 is an exploded perspective view illustrating a suction unit according to an embodiment of the present invention.
Figure 2:
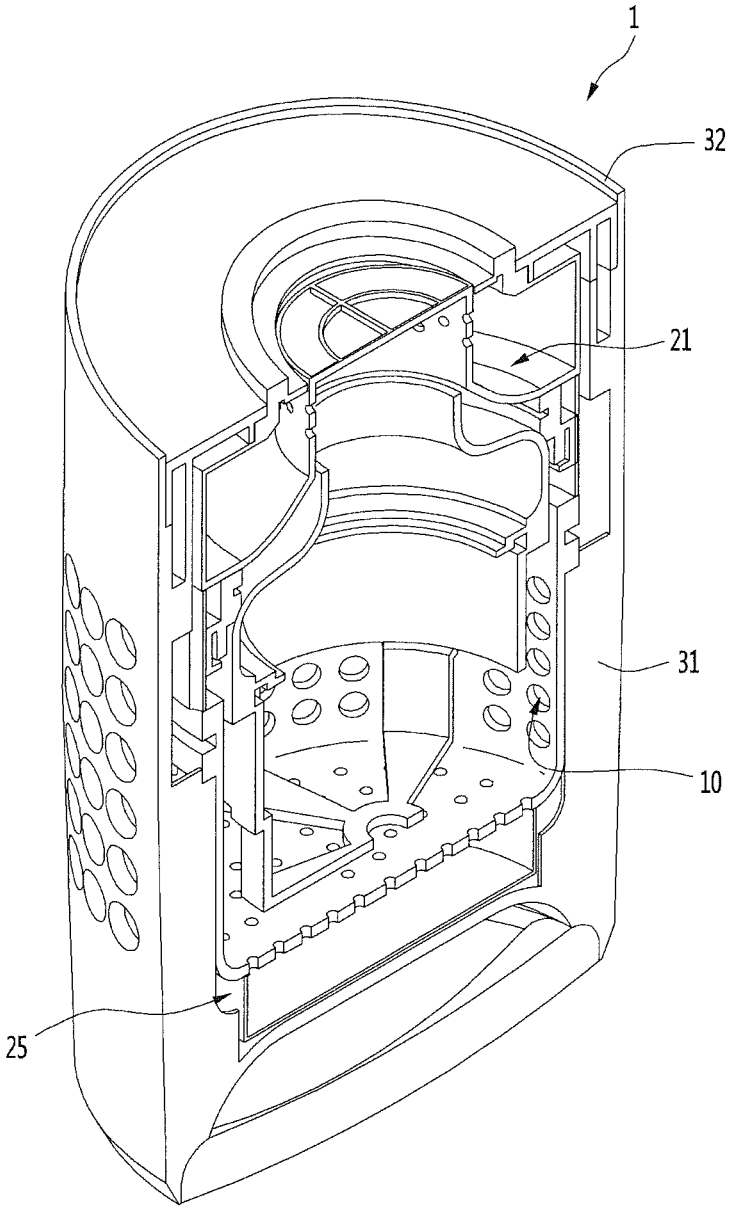
FIG. 2 is a cross-sectional view illustrating a suction unit according to an embodiment of the present invention.

FIG. 1 is an exploded perspective view illustrating a suction unit according to an embodiment of the present invention, and FIG. 2 is a cross-sectional view illustrating a suction unit according to an embodiment of the present invention.

Figure 3:
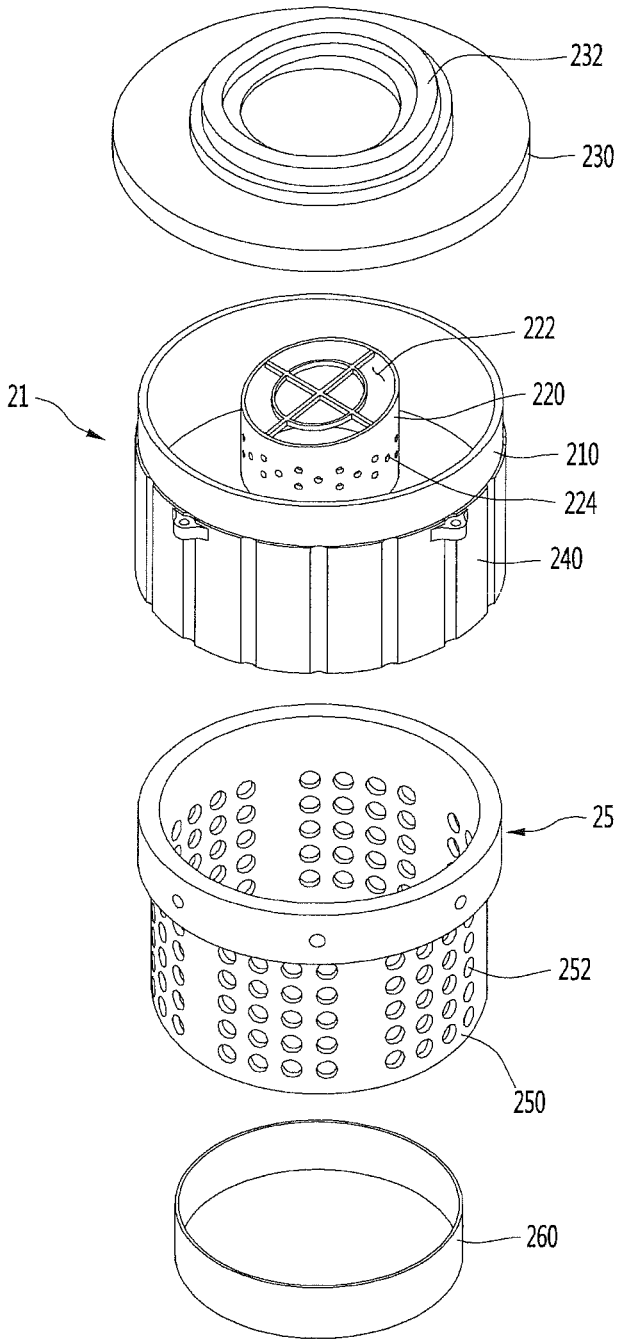
FIG. 3 is an exploded perspective view illustrating a noise reduction unit according to an embodiment of the present invention.

FIG. 3 is an exploded perspective view illustrating a noise reduction unit according to an embodiment of the present invention.

Figure 4:
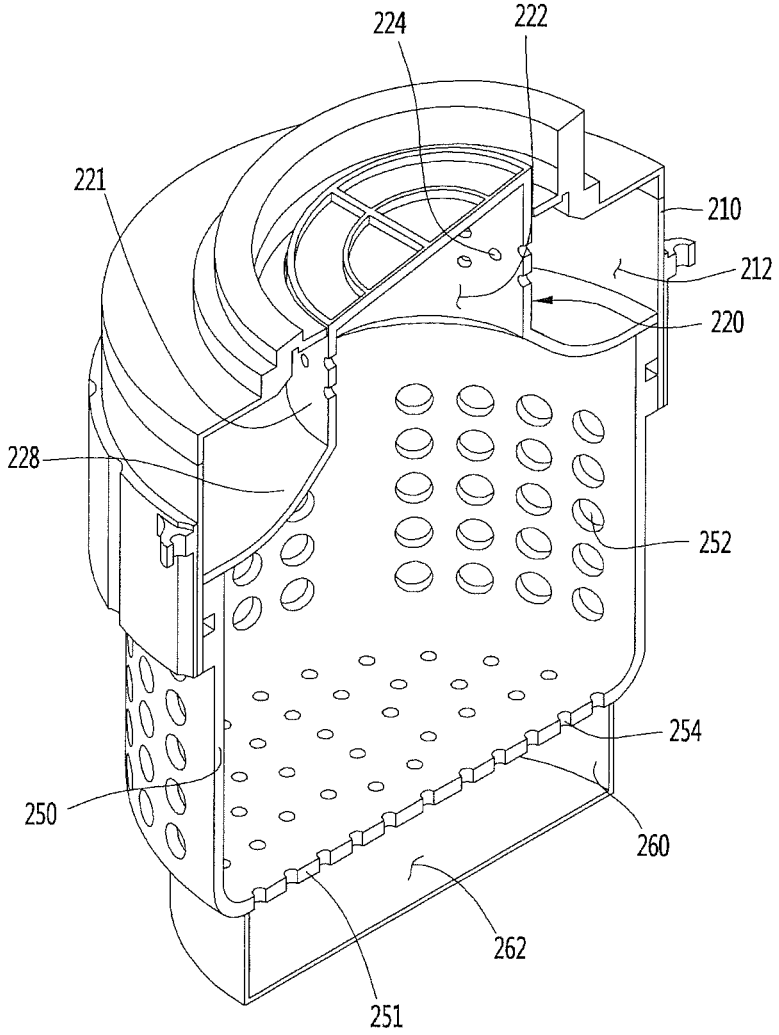
FIG. 4 is a cross-sectional view illustrating a noise reduction unit according to an embodiment of the present invention.

FIG. 4 is a cross-sectional view illustrating a noise reduction unit according to an embodiment of the present invention.

With reference to FIG. 1 to FIG. 4, the suction unit 1 according to the an embodiment of the present invention may be mounted on the inside of the vacuum cleaner and then may be used, as an example.

The suction unit 1 may include a suction motor 10 for generating the suction force, a noise reduction unit 20 for housing the suction motor 10 and reducing the noise generated during the operation of the suction motor 10, and a motor chamber 30 housing the noise reduction unit 20.

The suction motor 10 may include an impeller (not illustrated) and a drive portion for rotating the impeller and since the suction motor 10 due to known structures may be implemented in the present example, a detailed description regarding those is omitted.

The motor chamber 30 may include a first motor chamber 31 and a second motor chamber 32 which is coupled with the first motor chamber 31.

An inlet 320 through which air is passed is provided in the second motor chamber 32 and an outlet 312 from which the air is passed by the suction motor 10 is discharged is provided in the first motor chamber 31.

The noise reduction unit 20 may include a first reduction unit 21 and a second reduction unit 25 coupled with the first reduction unit 21.

The first reduction unit 21 is positioned on the upstream of the suction motor 10 and the second reduction unit 25 may be positioned on the downstream of the suction motor 10.

The noise reduction unit 20 may surround the suction motor 10. In other words, the noise reduction unit 20 is disposed in the inside of the motor chamber 30 and the suction motor 10 is positioned in the inside of the noise reduction unit 20, in the present embodiment.

According to the present invention, since the noise reduction unit 20 is primarily capable of reducing the noise and the motor chamber 30 is secondarily capable of reducing the noise. Accordingly, there is an advantage that the noise generated during the operation of the suction motor 10 may be further reduced.

The noise reduction unit 20 reduces the noise according to elimination of the noise of the specific frequency band and the suction motor 10 is shielded. Accordingly, the noise reduction unit 20 serves to prevent noise from propagating to the outside.

The first reduction unit 21 may be coupled to the upper side of the second reduction unit 25, as an example.

At this time, in a case where the second reduction unit 25 is omitted, the first reduction unit 21 may be coupled to the motor chamber 30. Alternatively, in a case where the first reduction unit 21 is omitted, the second reduction unit 25 may be coupled to the motor chamber 30.

The first reduction unit 21 may include a frame which surrounds a portion of the suction motor 10. The frame may include a first frame 210 and a second frame 230 which is coupled to the upper side of the first frame 210, but it is not limited to this.

An air flowing portion 232 for causing air to flow to the suction motor 10 may be provided in the second frame 230. The air flowing portion 232 may be inserted into the inlet 320 of the first motor chamber 32.

An air guide portion 220 in which air passed by the air flowing portion 232 is guided in the suction motor 10 may be provided in the first frame 210.

The air guide portion 220 may include a guide body 221 which has a smaller diameter than the diameter of the inner peripheral surface of the first frame 210 and an extending portion 228 which is extended from the guide body 221 in the radial direction.

The guide body 221 may be formed in a cylindrical shape and has an air flow path 222 for flowing of air, as an example. At this time, air flows the air flow path 222 in the axial direction of the guide body 221.

The extending portion 228 is extended in the radial direction in the guide body 221 and then may be in contact with the inner peripheral surface of the first frame 210.

At least one first communicating hole 224 may be formed in the guide body 221. FIG. 4 is a view illustrating that a plurality of first communicating holes 224 are formed in the guide body 221.

The outer peripheral surface of the guide body 221 and the inner peripheral surface of the first frame 210 define the first noise reduction chamber 212.

In the present embodiment, the plurality of first communicating holes 224 formed in the guide body 221 and the first noise reduction chamber 212 serve as a first resonator. At this time, a first noise reduction chamber 212 may be communicate with the plurality of the first communicating holes 224. The first noise reduction chamber 212 is disposed to surround the guide body 221.

The plurality of first communicating holes 224 serve as an inlet which allows the sound wave of the noise to enter the first noise reduction chamber 212.

Specifically, a specific standing wave of the noise which is generated during operation of the suction motor 10 as a noise which is generated while air flows the suction motor 10 is moved to the first noise reduction chamber 212 passing by the plurality of first communicating holes 224. The specific standing wave moved to the first noise reduction chamber 212 is changed to the vibration in an out of phase form and then passes through the first communicating hole 224. Accordingly, a phase shifting with respect to the specific standing wave generates and then the specific standing wave generated at the suction unit 1 is eliminated. According to this, the noise may be reduced.

At this time, since air flows an inner space of the guide body 221, so that the flow noise due to the first communicating hole 224 is not generated, the plurality of first communicating holes 224 may be disposed to be spaces apart in the circumferential direction of the guide body 221.

If a first communicating hole is formed on the guide body 221, swirl is generated in the perimeter of the first communicating hole by the first communicating hole in a process during which air passes through the guide body 221. According to this, there may be a problem that the flow noise of air is generated.

In a case where a plurality of first communicating holes 224 are formed in the circumferential direction of the guide body 221 as the present embodiment, and air flows in the axial direction of the guide body 221, air is prevented from being concentrated on only a portion of the plurality of first communication holes 224. Accordingly, swirl is prevented from being generated in the first communicating hole. Accordingly, the flow noise of air may be prevented from being generated by the swirl.

Naturally, a portion of the plurality of the first communicating holes 224 may be disposed to be space apart in the axial direction of the guide body 221.

The noise with specific frequency bands which is generated in the suction unit 1 may be reduced by adjusting the number of the plurality of first communicating holes 224, the diameter and the length of the plurality of first communicating holes 224, and the volume of the first noise reduction chamber 212.

The frame cover 240 may be provided in the outside of the first frame 210. The frame cover 240 may be fastened to the motor chamber 30.

Meanwhile, the second reduction unit 25 may further include a motor cover 250 which covers the suction motor 10 and a chamber forming portion 260 which is coupled to the outside of the motor cover 250.

The motor cover 250 may form in a cylindrical shape with upper side being opened, as an example, and may have a plurality of air holes 252 in the circumferential direction.

The motor cover 250 may be coupled with the first frame 210 but it is not limiting to this. As an example, a portion of the upper side of the motor cover 250 may be fastened to the motor cover 250 and the first frame 210 by a screw in a state where the a portion of the upper side of the motor cover 250 is inserted into the first frame 210. In the present invention, there is no restriction in the fastening method of the motor cover 250 and the first frame 210.

At least one second communicating hole may be formed in the bottom wall 251 of the motor cover 250. FIG. 4 is a view illustrating that a plurality of first communicating holes 254 are formed in the bottom wall 251, as an example.

The chamber forming portion 260 is coupled to the bottom wall 251 in the outside of the motor cover 250 and thus may form the first noise reduction chamber 262 with the bottom wall 251.

In other words, in the present embodiment, the plurality of second communicating holes 254 and the second noise reduction chamber 262 serve as a second resonator. At this time, a second noise reduction chamber 260 may be communicate with the plurality of the second communicating holes 254. The internal space of the motor cover 250 provides an air flow path in which air discharged from the suction motor 20 flows.

The noise with specific frequency bands which is generated in the suction unit 1 may be reduced by adjusting the number of the plurality of second communicating holes 254, the diameter and the length of the plurality of second communicating holes 254, and the volume of the second noise reduction chamber 262.

At this time, the first resonator and the second resonator may be designed to have natural frequencies which are different from each other.

For example, the number, the diameter, or the length of the inlet hole of the first resonator may be designed to be different from the number, the diameter, or the length of the inlet hole of the second resonator.

Alternatively, the volume of the noise reduction chamber of the first resonator may be designed to be different from the volume of the noise reduction chamber of the second resonator.

Figure 5:
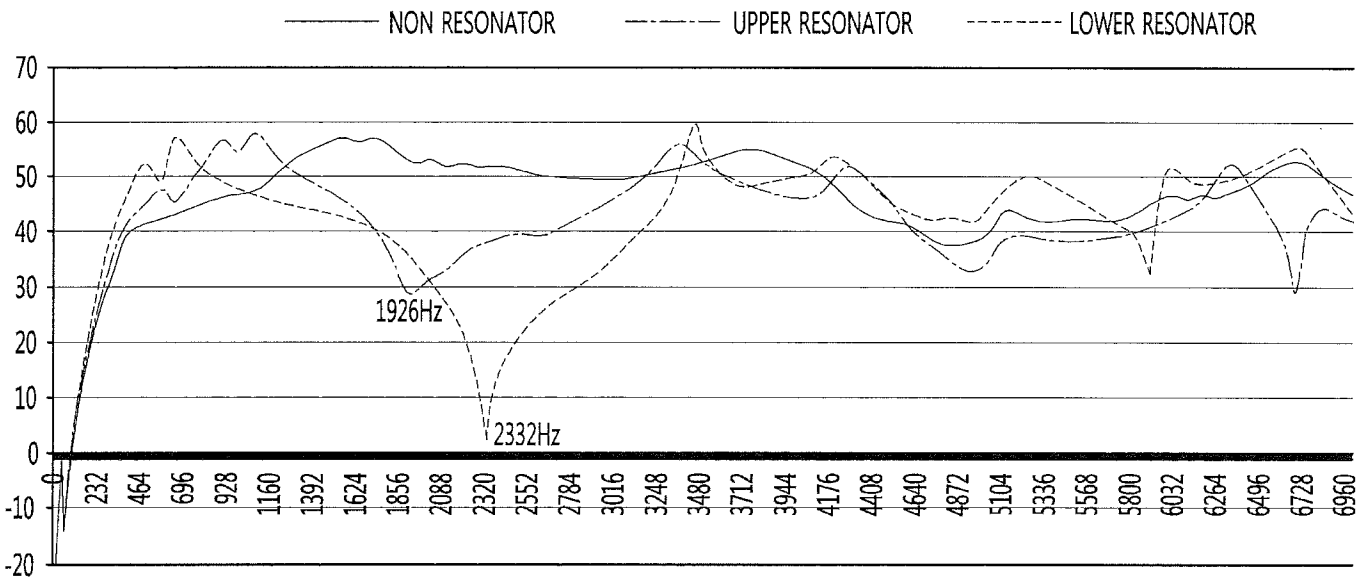
FIG. 5 is a graph illustrating frequency-dependent noise according to the presence or absence of the noise reduction unit.

FIG. 5 is a graph illustrating frequency-dependent noise according to the presence or absence of the noise reduction unit.

With reference to FIG. 5, it can be found that about 1900 hz of frequency noise may remarkably reduced by the first reduction unit 21 by the natural frequencies of the first reduction unit 21 and the second reduction unit 25 being designed to be different from each other and about 2300 hz of frequency noise is remarkably reduced by the second reduction unit 25.

The graph in FIG. 5 is an example and the frequency band of the noise may be differentiated according to specification, structure or the type of the suction motor 10 and according to this, the natural frequency of the noise reduction unit may be also differentiated.

Figure 6:
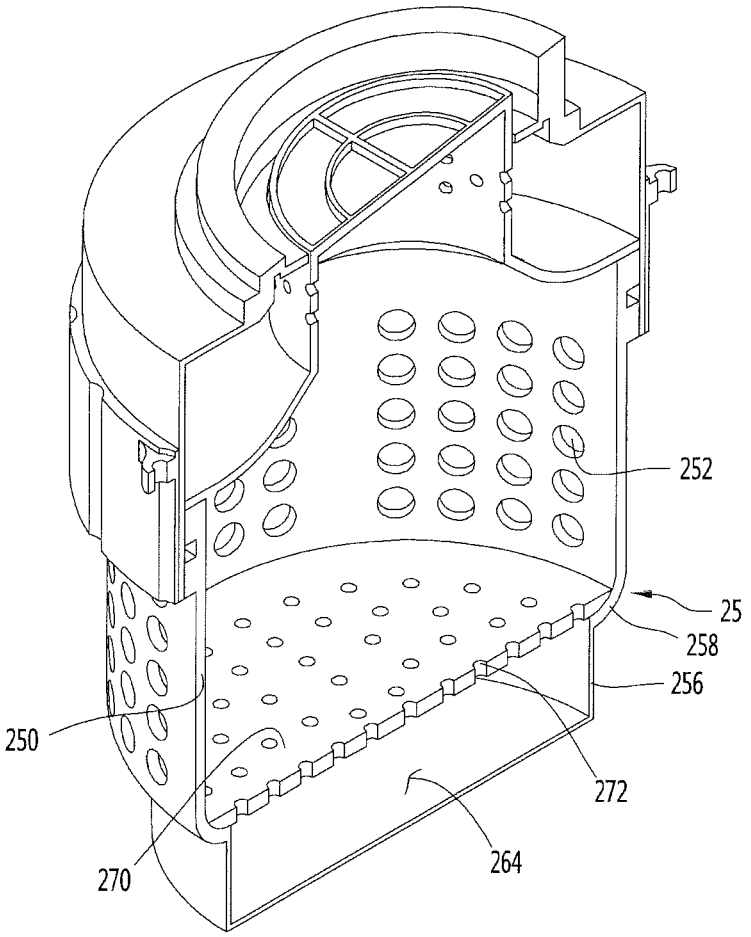
FIG. 6 is a cross-sectional view illustrating a noise reduction unit according to the other embodiment of the present invention.

FIG. 6 is a cross-sectional view illustrating a noise reduction unit according to the other embodiment of the present invention.

The present embodiment is the same as the previous embodiments in the other part except for the structure of the second resonator in the noise reduction unit. Accordingly, hereinafter, only the characteristic parts of the present embodiment will be described.

With reference to FIG. 6, the second noise reduction unit 25 of the present embodiment may include the motor cover 250.

The motor cover 250 may include a chamber forming portion 256 for forming the second noise reduction chamber 264. The chamber forming portion 256 may be a portion in which the diameter of the motor cover 250 is reduced compared to the other portion. However, it is not limited to this.

Accordingly, the motor cover 250 may include a step portion 258 and chamber forming wall 270 for forming the second noise reduction chamber 64 may be seated in the step portion 258. The plurality of second communicating holes 272 may be formed in the chamber forming wall 270.

According to the present embodiment, the plurality of second communicating holes 272 of the chamber forming wall 270 and the second noise reduction chamber 264 serve as a second resonator.

What is claimed is:

1. A suction unit, comprising:

a suction motor that is configured to move air;

a noise reduction unit that is configured to receive the suction motor, that is configured to reduce noise generated during operation of the suction motor by acting as a resonator, that includes a first reduction unit that is located upstream from the suction motor and a second reduction unit that is located downstream from the suction motor, and that defines (i) an air flow path for air moved by the suction motor, (ii) a noise reduction chamber that is configured to reduce noise in at least one frequency band, and (iii) at least one communicating hole that guides noise to the noise reduction chamber; and a motor chamber that is configured to receive the noise reduction unit, wherein the air flow path is separated from the noise reduction chamber, and wherein the noise reduction chamber is configured to receive noise through the communicating hole based on air flowing through the air flow path.

2. The suction unit of claim 1, wherein:

the noise reduction unit defines a plurality of communicating holes, and the noise reduction chamber is configured to receive noise through the plurality of communicating holes.

3. The suction unit of claim 1, wherein the second reduction unit is coupled with the first reduction unit.

4. The suction unit of claim 1, wherein:

each of the first reduction unit and the second reduction unit includes a plurality communicating holes and defines a portion of the noise reduction chamber, and the first reduction unit is configured to reduce noise in a first frequency band and the second reduction unit is configured to reduce noise in a second frequency band that is different than the first frequency band, based on a number, a density, or a diameter of the plurality of communicating holes of the first reduction unit being different from a number, a density, or a diameter of the plurality of communicating holes of the second reduction unit.

5. The suction unit of claim 1, wherein:

the first reduction unit includes a first frame that is configured to receive a portion of the suction motor;

the suction unit further comprises:

an air guide portion that is configured to guide air into the portion of the suction motor in the first frame and that defines a plurality of first communicating holes; and a second frame that is configured to receive the first frame; and the air guide portion, the first frame, and the second frame define the noise reduction chamber.

6. The suction unit of claim 5, wherein:

the second reduction unit includes a motor cover that is configured to receive a portion of the suction motor and that defines a plurality of second communicating holes, the suction unit further comprises a chamber forming portion that is configured to receive a portion of an outer peripheral surface of the motor cover, and the motor cover and the chamber forming portion define the noise reduction chamber.

7. The suction unit of claim 5, wherein:

the second reduction unit includes a motor cover that is configured to receive a portion of the suction motor, the suction unit further comprises a chamber forming wall that is located on an inner stepped portion of the motor cover and that defines a plurality of second communicating holes, and the motor cover and the chamber forming wall define the noise reduction chamber.

8. A suction unit, comprising:

a suction motor that is configured to move air;

a noise reduction unit that is configured to receive the suction motor, that is configured to reduce noise generated during operation of the suction motor by acting as a resonator, that includes a first frame that is configured to receive a portion of the suction motor, and that defines (i) an air flow path for air moved by the suction motor, (ii) a noise reduction chamber that is configured to reduce noise in at least one frequency band, and (iii) at least one communicating hole that guides noise to the noise reduction chamber;

a motor chamber that is configured to receive the nose reduction unit;

an air guide portion that guides air into the portion of the suction motor that is in the first frame and that defines a plurality of communicating holes; and a second frame that is configured to receive the first frame, wherein the air flow path is separated from the noise reduction chamber, wherein the noise reduction chamber is configured to receive noise through the communicating hole based on air flowing through the air flow path, and wherein the air guide portion, the first frame, and the second frame define the noise reduction chamber.

9. The suction unit of claim 8, wherein:

the air guide portion is located in the first frame, and a portion of an inner peripheral surface of the first frame and an outer peripheral surface of the air guide portion define the noise reduction chamber.

10. The suction unit of claim 8, wherein the air guide portion includes a guide body that is configured to guide air in an axial direction of the suction unit and that defines a plurality of communicating holes that are located in a circumferential side of the guide body.

11. The suction unit of claim 10, wherein the noise reduction chamber is configured to receive the guide body.

12. The suction unit of claim 8, wherein the air guide portion includes a guide body that is configured to guide air in an axial direction of the suction unit and that defines a plurality of communicating holes that are located in a base of the guide body.

13. A suction unit, comprising:

a suction motor that is configured to move air;

a noise reduction unit that is configured to receive the suction motor, that is configured to reduce noise generated during operation of the suction motor by acting as a resonator, that includes a motor cover (i) that is configured to receive a portion of the suction motor and (ii) that defines a plurality of communicating holes, and that defines (i) an air flow path for air moved by the suction motor, (ii) a noise reduction chamber that is configured to reduce noise in at least one frequency band, and (iii) at least one communicating hole that guides noise to the noise reduction chamber;

a motor chamber that is configured to receive the noise reduction unit; and a chamber forming portion that is configured to receive a portion of an outer peripheral surface of the motor cover, wherein the air flow path is separated from the noise reduction chamber, wherein the noise reduction chamber is configured to receive noise through the communicating hole based on air flowing through the air flow path, and wherein the motor cover and the chamber forming portion define the noise reduction chamber.

14. A suction unit, comprising:

a suction motor that is configured to move air;

a noise reduction unit that is configured to receive the suction motor, that is configured to reduce noise generated during operation of the suction motor by acting as a resonator, that includes a motor cover that is configured to receive a portion of the suction motor, that defines (i) an air flow path for air moved by the suction motor, (ii) a noise reduction chamber that is configured to reduce noise in at least one frequency band, and (iii) at least one communicating hole that guides noise to the noise reduction chamber;

a motor chamber that is configured to receive the noise reduction unit; and a chamber forming wall that is located on an inner stepped portion of the motor cover and that defines a plurality of communicating holes, wherein the air flow path is separated from the noise reduction chamber, wherein the noise reduction chamber is configured to receive noise through the communicating hole based on air flowing through the air flow path, and wherein the motor cover and the chamber forming wall define the noise reduction chamber.

15. A suction unit, comprising:

a suction motor that is configured to move air;

a first reduction unit that is configured to receive the suction motor, that is located upstream from the suction motor, that is configured to reduce noise generated by the suction motor by acting as a resonator, and that defines (i) a first noise reduction chamber that is configured to reduce noise in at least one first frequency band and (ii) at least one first communicating hole that is configured to guide noise to the first noise reduction chamber;

a second reduction unit that is configured to receive the suction motor, that is located downstream from the suction motor, that is configured to reduce noise generated by the suction motor by acting as a resonator, and that defines (i) a second noise reduction chamber that is configured to reduce noise in at least one second frequency band and (ii) at least one second communicating hole that is configured to guide noise to the second noise reduction chamber; and a motor chamber that surrounds the first reduction unit and the second reduction unit.

16. The suction unit of claim 15, wherein:

the first reduction unit includes a first frame that is configured to receive a portion of the suction motor, the suction unit further comprises:

an air guide portion that is configured to guide air into the portion of the suction motor in the first frame and that defines the at least one first communicating hole; and a second frame that covers the first frame, and the air guide, the first frame, and the second frame define the noise reduction chamber.

17. The suction unit of claim 15, wherein:

the second reduction unit includes a motor cover that is configured to receive a portion of the suction motor and that defines a plurality of air holes and a plurality of communicating holes, the suction unit further comprises a chamber forming portion that is configured to receive a portion of an outer peripheral surface of the motor cover, and the motor cover and the chamber forming portion define the noise reduction chamber.

18. The suction unit of claim 15, wherein:

the second reduction unit includes a motor cover that is configured to receive a portion of the suction motor and that defines a plurality of air holes, the suction unit further comprises a chamber forming wall that is located on an inner stepped portion of the motor cover and that defines a plurality of communicating holes, and the motor cover and the chamber forming wall define the noise reduction chamber.

19. The suction unit of claim 15, wherein:

the motor chamber defines an inlet that is configured to receive air and an outlet that is configured to discharge air from the second reduction unit.

* * * * *